US010113355B2

(12) United States Patent
Wang

(10) Patent No.: US 10,113,355 B2
(45) Date of Patent: Oct. 30, 2018

(54) SOUNDPROOF DOOR FOR USE IN REDUCTION OF SOUND TRANSMITTED FROM ONE SIDE OF THE DOOR TO THE OTHER SIDE

(71) Applicant: NAN YA PLASTICS CORPORATION, Taipei (TW)

(72) Inventor: Kuei Yung Wang, Taipei (TW)

(73) Assignee: NAN YA PLASTICS CORPORATION (TW)

( * ) Notice: Subject to any disclaimer, the term of this patent is extended or adjusted under 35 U.S.C. 154(b) by 0 days.

(21) Appl. No.: 15/277,475

(22) Filed: Sep. 27, 2016

(65) Prior Publication Data

US 2017/0022752 A1 Jan. 26, 2017

Related U.S. Application Data

(63) Continuation-in-part of application No. 14/808,351, filed on Jul. 24, 2015.

(51) Int. Cl.

| | |
|---|---|
| ***E06B 5/20*** | (2006.01) |
| ***E06B 3/20*** | (2006.01) |
| ***E06B 3/263*** | (2006.01) |
| ***E06B 3/70*** | (2006.01) |
| ***G10K 11/168*** | (2006.01) |
| ***E06B 3/82*** | (2006.01) |

(52) U.S. Cl.

CPC ..... *E06B 5/20* (2013.01); *E06B 3/20* (2013.01); *E06B 3/26345* (2013.01); *E06B 3/7015* (2013.01); *E06B 3/822* (2013.01); *G10K 11/168* (2013.01); *E06B 2003/7023* (2013.01); *E06B 2003/7051* (2013.01); *E06B 2003/7082* (2013.01)

(58) Field of Classification Search

CPC ... E06B 5/20; E06B 3/822; E06B 3/20; E06B 3/26345; E06B 3/7015; E06B 2003/7082; E06B 2003/7023; E06B 2003/7051; G10K 11/168

USPC ..... 52/204.1, 455, 782.1, 783.12, 784.15, 52/309.1

See application file for complete search history.

(56) References Cited

U.S. PATENT DOCUMENTS

| | | | | |
|---|---|---|---|---|
| 2,922,202 A * | 1/1960 | Kodaras | E06B 5/20 | 181/287 |
| 3,120,295 A * | 2/1964 | Lemmerman | E04B 1/8218 | 181/292 |
| 3,273,297 A * | 9/1966 | Wehe, Jr. | E06B 3/7015 | 181/294 |
| 3,295,273 A * | 1/1967 | Wehe, Jr. | E06B 3/822 | 181/292 |
| 3,950,894 A * | 4/1976 | DiMaio | E06B 3/7001 | 292/251.5 |

(Continued)

*Primary Examiner* — Brent W Herring

(74) *Attorney, Agent, or Firm* — Ostrolenk Faber LLP

(57) ABSTRACT

A soundproof door having a multiple-layered core to form a concrete inner portion of the soundproof door, the multiple-layered core due to particularly constituted by having a soft-soundproofing core interleaved in between two spaced hard-soundproofing cores to form as a whole as a sandwich structure are excellent in sound isolation for soundproof door, and the soundproof door at least has an STC of 30, determined in accordance with ASTM E413-10 and E90-09, to minimize the transmission of sound from one side of the soundproof door to the other side.

10 Claims, 9 Drawing Sheets

(56) References Cited

U.S. PATENT DOCUMENTS 4,307,543 A * 12/1981 Schulthess ..... E06B 5/164 49/501
6,318,036 B1 * 11/2001 Siudzinski ..... E06B 1/28 49/366
6,401,428 B1 * 6/2002 Glover ..... E06B 3/24 52/786.1
6,681,541 B2 * 1/2004 Wang Chen ..... E06B 5/16 52/309.9
8,074,766 B1 * 12/2011 Shore ..... E04B 1/86 181/285
8,573,357 B1 * 11/2013 Hibbs ..... E06B 5/20 181/287
9,051,731 B2 * 6/2015 Thomas ..... E04B 1/84
2003/0005645 A1 * 1/2003 Wang Chen ..... E06B 5/16 49/501
2004/0231914 A1 7/2004 Thompson, Jr.
2004/0231915 A1 11/2004 Thompson, Jr.
2005/0050846 A1 * 3/2005 Surace ..... B32B 7/12 52/782.1
2006/0096240 A1 * 5/2006 Fortin ..... B32B 5/26 52/784.11
2006/0289230 A1 12/2006 Connelly
2008/0196971 A1 8/2008 Charbonnier
2009/0178882 A1 7/2009 Johnson
2010/0066121 A1 3/2010 Gross
2010/0180526 A1 * 7/2010 An ..... E06B 3/7001 52/309.4
2010/0281805 A1 * 11/2010 Garrett ..... E06B 3/822 52/309.4
2011/0131921 A1 * 6/2011 Chen ..... E06B 3/86 52/784.1
2013/0025966 A1 1/2013 Nam
2013/0061522 A1 * 3/2013 Alexander ..... E06B 9/04 49/11
2013/0133261 A1 * 5/2013 Choi ..... E06B 3/822 49/9
2013/0209782 A1 8/2013 Kipp
2014/0000194 A1 * 1/2014 Daniels ..... E06B 3/822 52/232
2014/0000195 A1 * 1/2014 Daniels ..... B32B 13/02 52/232
2014/0054107 A1 * 2/2014 Thomas ..... E04B 1/84 181/290
2014/0202789 A1 7/2014 Heurtaux
2015/0068838 A1 3/2015 Keene
2016/0075108 A1 3/2016 Temblay

* cited by examiner

SOUNDPROOF DOOR FOR USE IN REDUCTION OF SOUND TRANSMITTED FROM ONE SIDE OF THE DOOR TO THE OTHER SIDE

CROSS REFERENCE TO RELATED APPLICATIONS

This application is a continuation-in-part of U.S. patent application Ser. No. 14/808,351 filed Jul. 24, 2015, now pending, which is incorporated by reference in its entirety herein.

BACKGROUND OF THE PRESENT INVENTION

1. Field of the Invention

The present invention relates to a soundproof door, and more particularly, to an improved soundproof door having an STC number greater than of STC 30 determined in accordance with ASTM E413-10 and E90-09.

2. Description of Related Art

A soundproof door is a door which has been designed or retrofitted to cut out as much external noise as possible.

However, most soundproof doors currently used in prior art are wooden doors or synthesized plastic doors, those doors are poor in sound isolation or acoustic insulation.

SUMMARY OF THE INVENTION

The major purpose of the present invention is to provide an improved soundproof door for use in reduction of sound transmitted from one side of the door to the other side, which improvement includes the soundproof door has a multiple-layered core to form a concrete inner portion of the soundproof door, the multiple-layered core particularly constituted by having a soft-soundproofing core interleaved in between two spaced hard-soundproofing cores to form as a whole as a sandwich structure are excellent in sound isolation for soundproof door, and the soundproof door at least has an STC of 30 determined in accordance with ASTM E413-10 and E90-09, so that the soundproof door may minimize the transmission of sound from one side of the soundproof door to the other side.

The structural composition of the soundproof door comprises two door skins one formed as a front door skin and the other formed as a rear door skin for the soundproof door respectively; a quadrilateral frame constituted by a top rail member, a bottom rail member, a left stile member and a right stile member to seal the perimeter of the door skins; and a multiple-layered core having function of sound isolation to form a concrete inner portion of the door, wherein the multiple-layered core comprises two spaced hard-soundproofing cores and a soft-soundproofing core interleaved in between the spaced hard-soundproofing cores to constitute with a sandwich structure.

The above-mentioned soundproof door may further comprises one or more reinforced members in parallel set up alongside one or more sides of the soft-soundproofing core, and both the soft-soundproofing core and each the reinforced member are interleaved in between the two spaced hard-soundproofing cores to constitute with a sandwich structure.

Another structural composition of the soundproof door comprises two door skins one formed as a front door skin and the other formed as a rear door skin for the soundproof door respectively; a quadrilateral frame constituted by a top rail member, a bottom rail member, a left stile member and a right stile member to seal the perimeter of the door skins; one or more reinforced members in parallel set up alongside one or more inner sides of the quadrilateral frame; and a multiple-layered core having function of sound isolation to form a concrete inner portion of the door, wherein the multiple-layered core comprises two spaced hard-soundproofing cores and a soft-soundproofing core interleaved in between the spaced hard-soundproofing cores to constitute with a sandwich structure.

The hard-soundproofing core may be made of either a single-layered soundproofing core or a multiple-layered soundproofing core constituted by two or more the single-layered soundproofing cores.

The hard-soundproofing core is made of wood plate, iron plate, calcium silicate board, gypsum board, magnesium oxide board, silicon magnesium board, glass fiber composite board or ceramic composite board.

The soft-soundproofing core is made of rock wool fiber board, ceramic fiber wool board, phenolic foaming board, glass fiber board, closed cell polyurethane foaming board, opened cell polyurethane foaming board, expandable polystyrene foaming board or expandable polyethylene foaming board.

The reinforced member is made of hard PVC board, PVC composite extrusion board, PS board, ABS board, hardwood board, high density particle board or LVL board.

DETAILED DESCRIPTION OF THE INVENTION

Figure 1:
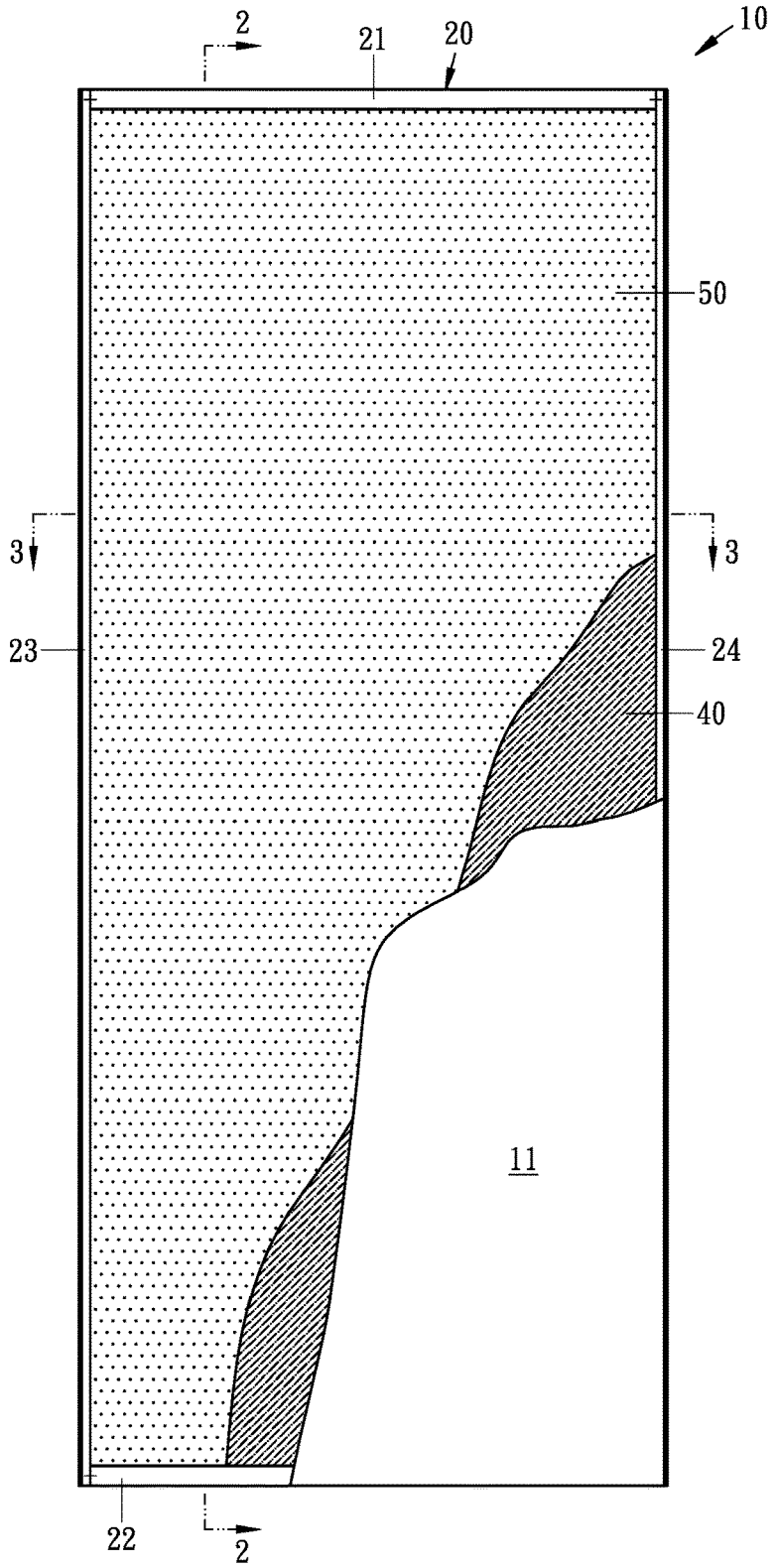
FIG. 1 is a schematic drawing of the soundproof door of the invention.
Figure 3:
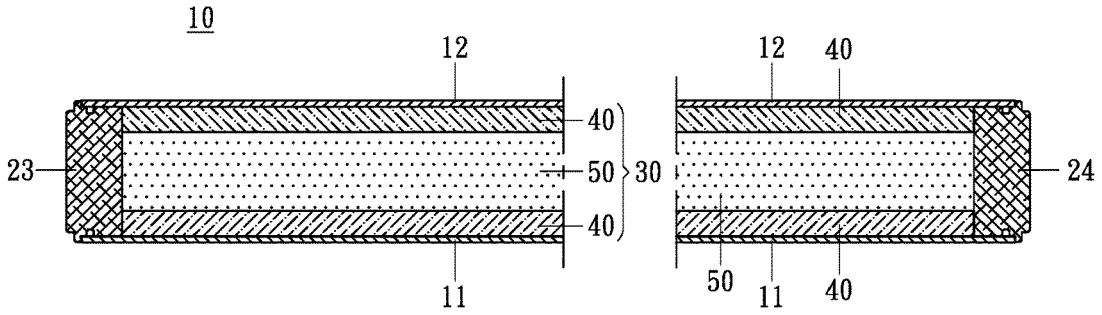
FIG. 3 is a partial enlargement of cross-sectional drawing along line 3-3 of the soundproof door in FIG. 1.
Figure 2:
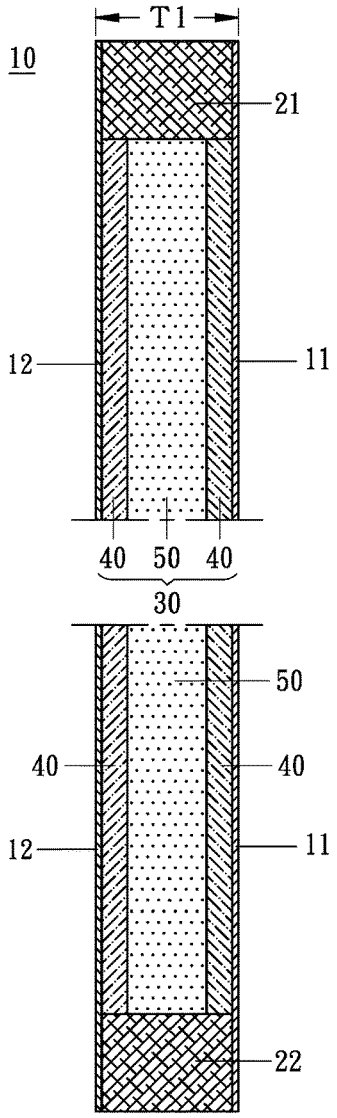
FIG. 2 is a partial enlargement of cross-sectional drawing along line 2-2 of the soundproof door in FIG. 1.

As shown in from FIG. 1 to FIG. 3, a soundproof door 10 disclosed in this present invention has a total thickness T1 ranged from 30 mm to 70 mm and comprises two door skins 11 and 12 formed as a front door skin and a rear door skin for the soundproof door 10 respectively, a quadrilateral frame 20 constituted by a top rail member 21, a bottom rail member 22, a left stile member 23 and a right stile member 24 to seal the perimeter of door skins 11 and 12 of the soundproof door 10, and a multiple-layered core 30 to form a concrete inner portion of the soundproof door 10.

Figure 7:
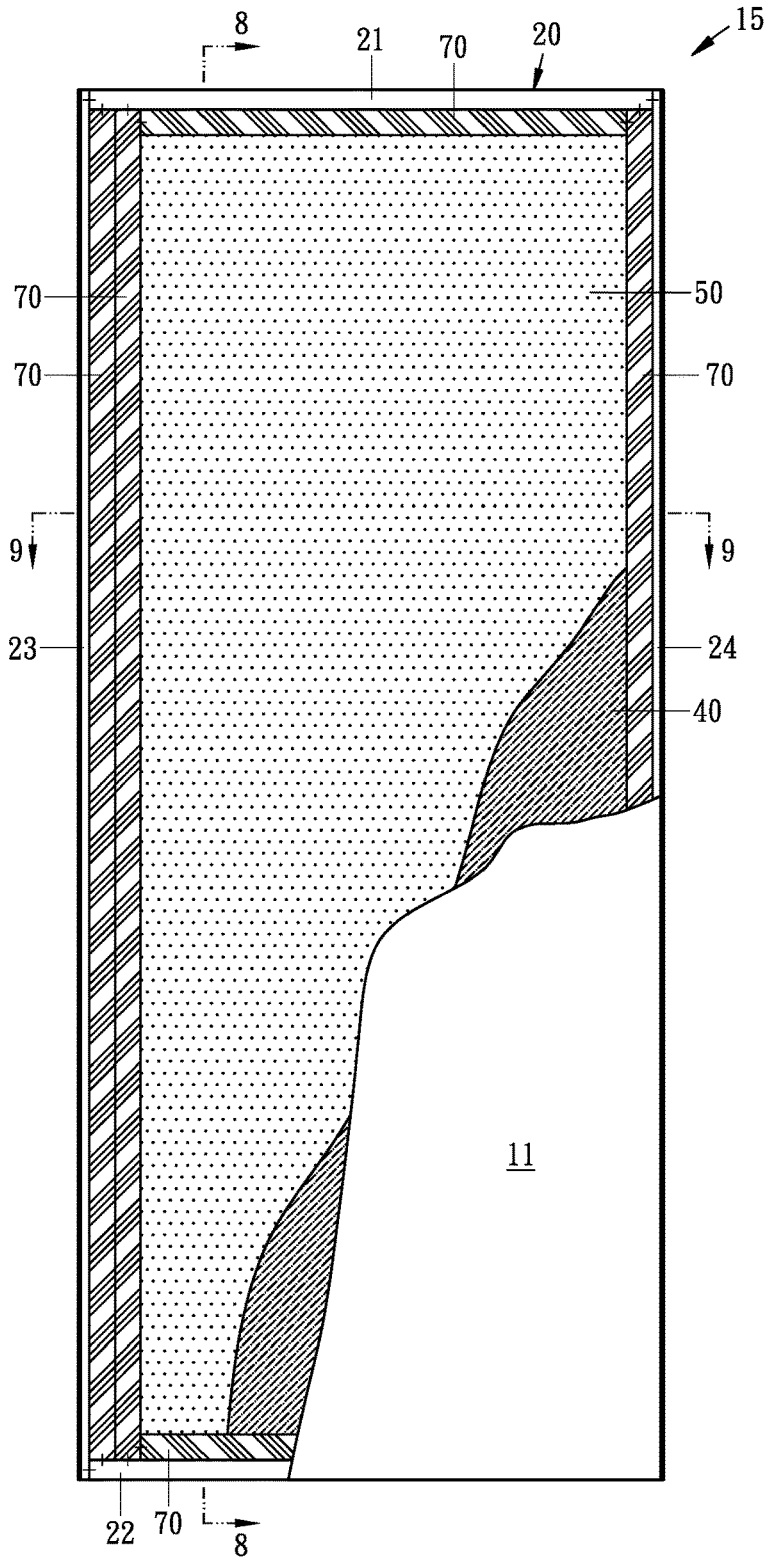
FIG. 7 is a schematic drawing of further another embodiment of the soundproof door of the invention.
Figure 9:
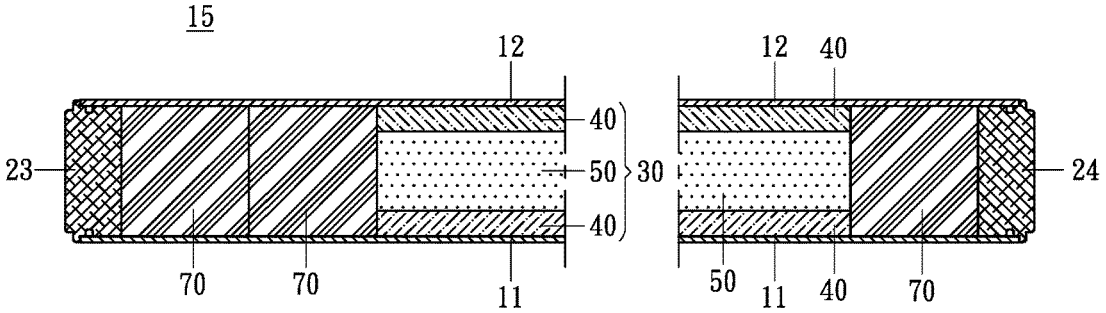
FIG. 9 is a partial enlargement of cross-sectional drawing along line 9-9 of the soundproof door in FIG. 7.
Figure 8:
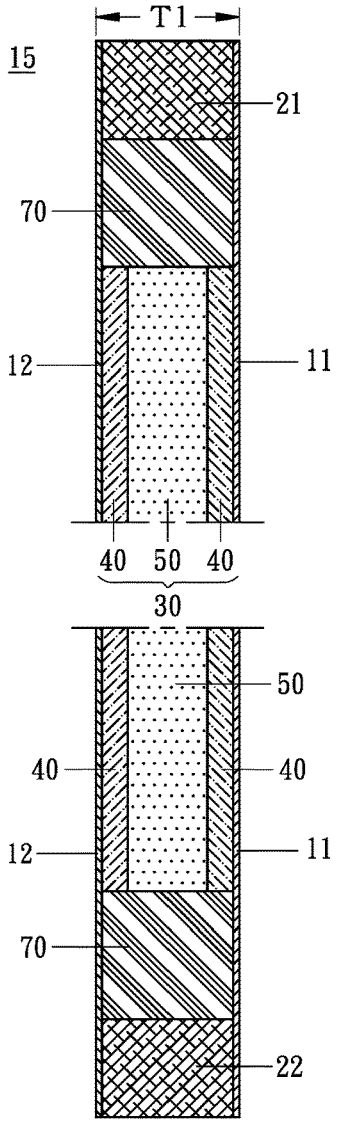
FIG. 8 is a partial enlargement of cross-sectional drawing along line 8-8 of the soundproof door in FIG. 7.

As shown in from FIG. 7 to FIG. 9, another embodiment of the soundproof door 15 of the present invention still has a total thickness T1 ranged from 30 mm to 70 mm and comprises the door skins 11 and 12 of the soundproof door 15, the quadrilateral frame 20 to seal the perimeter of door skins 11 and 12, one or more reinforced members 70 in parallel set up alongside one or more inner sides of the quadrilateral frame 20 of the soundproof door 15, and the multiple-layered core 30 to form a concrete inner portion of the soundproof door 15.

Particularly, the multiple-layered core 30 of the soundproof door 10 or 15 of the present invention has function of sound isolation to minimize the transmission of sound from one side of the soundproof door 10 or 15 to the other side.

The door skin 11 or 12 has a thickness of 1-5 mm and is made of fiber reinforced plastic (FRP) sheet, SMC sheet, BMC sheet, wood plate, iron plate, PVC sheet, PS sheet, ABS sheet or laminated veneer lumber (LVL) sheet. Wherein the SMC sheet is made of fiber reinforced plastic (FRP) by sheet molding compound method, and the BMC sheet is made of fiber reinforced plastic (FRP) by Bulk Molding Compound method.

Figure 10:
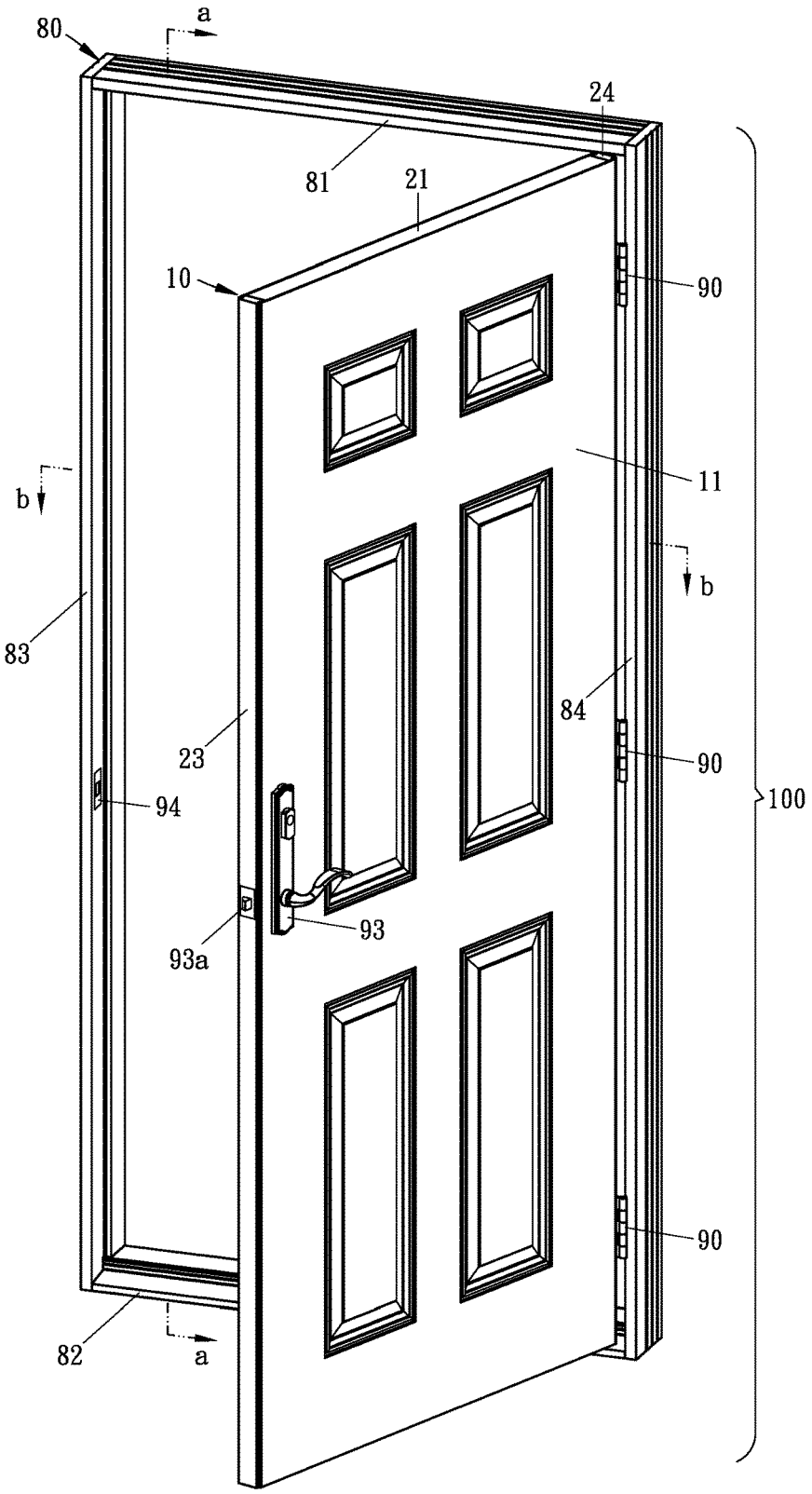
FIG. 10 is a schematic drawing of the soundproof door assembly of the invention.

Further, the door skin 11 or 12 can be shaped either as a flat door skin of which door surface is a flat surface or as a panel door skin of which door surface as depicted in FIG. 10 has decorative panel patterns formed on the door surface. The door skin 11 or 12 may have a smooth surface without wood grain or with imitating wood grain. The door skin 11 or 12 may have a rough back surface for increasing the binding force when they are bond together with the quadrilateral frame 20 and the multiple-layered core 30, or further with the reinforced member 70.

The quadrilateral frame 20 including the top rail member 21, the bottom rail member 22, the left stile member 23 and the right stile member 24 is made of hard PVC board, foamed PVC board, PVC composite extrusion board, hardwood board, high density particle board, laminated veneer lumber (LVL) board, stainless steel plate, galvanized and coated steel plate or calcium silicate plate.

The multiple-layered core 30 at least comprises two spaced hard-soundproofing cores 40 and a soft-soundproofing core 50 interleaved in between the two spaced hard-soundproofing cores 40 to constitute with a sandwich structure.

Figure 4:
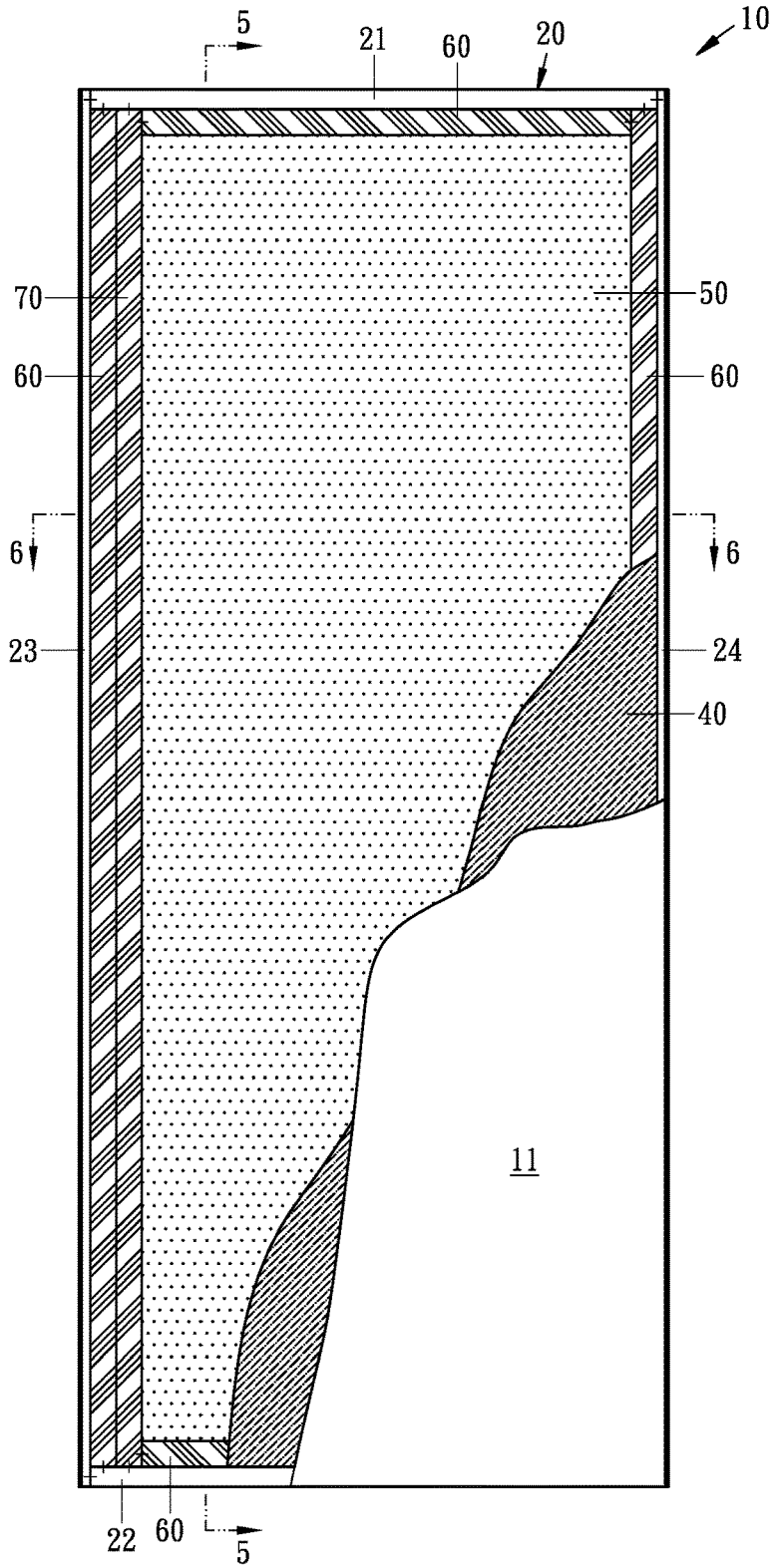
FIG. 4 is a schematic drawing of another embodiment of the soundproof door of the invention.
Figure 6:
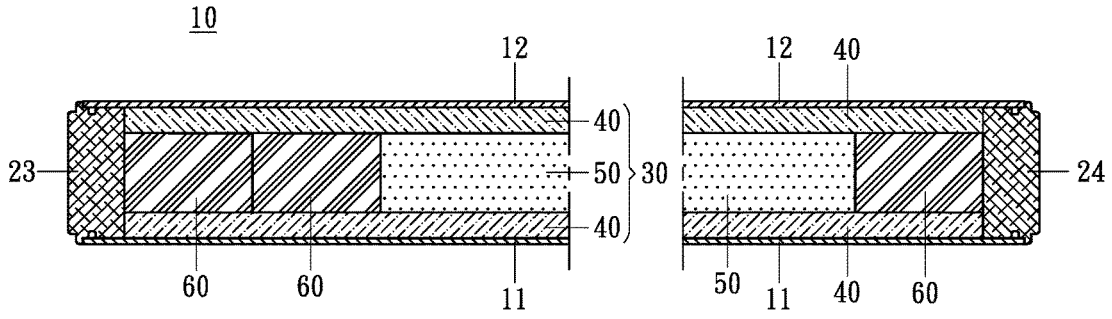
FIG. 6 is a partial enlargement of cross-sectional drawing along line 6-6 of the soundproof door in FIG. 4.
Figure 5:
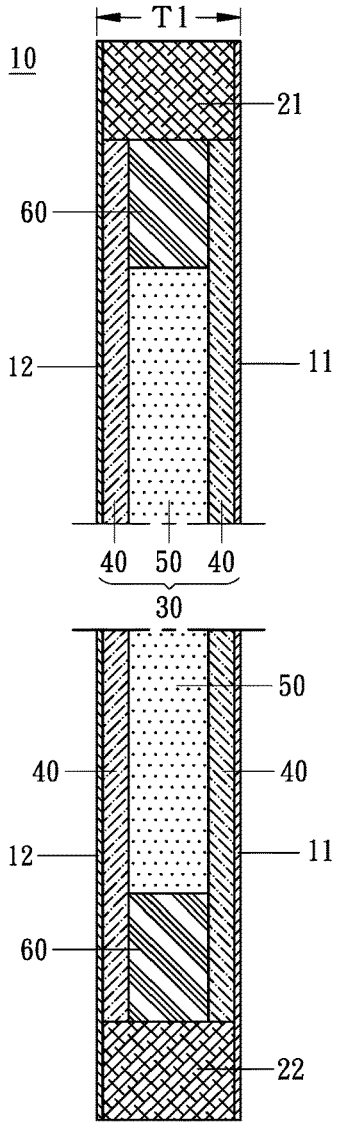
FIG. 5 is a partial enlargement of cross-sectional drawing along line 5-5 of the soundproof door in FIG. 4.

As shown in from FIG. 4 to FIG. 6, another practical embodiment of the multiple-layered core 30 comprises the two spaced hard-soundproofing cores 40, the soft-soundproofing core 50 and one or more reinforced members 60 in parallel set up alongside one or more sides, preferably each side, of the soft-soundproofing core 50 thereof, and in particular both the soft-soundproofing core 50 as well as the reinforced member 60 are interleaved in between the two spaced hard-soundproofing cores 40 to constitute with a sandwich structure.

The hard-soundproofing core 40 has a thickness of 3-12 mm and is made of either a single-layered soundproofing core or a multiple-layered soundproofing core constituted by two or more the single-layered soundproofing cores.

The hard-soundproofing core 40 has an excellent soundproofing ability to preferably block sound with high frequency over 500 Hz and is made of wood plate, iron plate, calcium silicate board, gypsum board, magnesium oxide board, silicon magnesium board, glass fiber composite board or ceramic composite board.

The soft-soundproofing core 50 has an excellent soundproofing ability to preferably block sound with low frequency beneath 500 Hz and is made of rock wool fiber board, ceramic fiber wool board, phenolic foaming board, glass fiber board, closed cell polyurethane foaming board, opened cell polyurethane foaming board, expandable polystyrene (EPS) foaming board or expandable polyethylene (EPE) foaming board.

The reinforced member 60 or 70 has an excellent rigidity and is made of hard PVC board, PVC composite extrusion board, PS board, ABS board, hardwood board, high density particle board or LVL board.

As shown in FIG. 10, a soundproof door assembly 100 of the present invention for use as a building structure is further disclosed to improve sound isolation qualities. The structural component of the soundproof door assembly 100 comprises the above-mentioned soundproof door 10 (or 15), a doorframe 80 used to support the soundproof door 10 (or 15) and one or more door hinges 90 used to control the soundproof door 10 (or 15) capably to swing relative to the doorframe 80.

The doorframe 80 is a quadrilateral door frame constituted by four components including a header 81, a doorsill 82, a strike jamb 83 and a hinge jamb 84, and each component is an integral structure made of thermoplastic material by extruding forming technique, wooden material or metal material.

Each component of the doorframe 80 is made from hard polyvinyl chloride (PVC) board, foamed PVC board, PVC composite extrusion board, hardwood plate, stainless steel plate, aluminum alloy plate, galvanized and coated steel plate, or calcium silicate plate, and preferably made from hard polyvinyl chloride (PVC) board, foamed PVC board or PVC composite extrusion board.

Figure 11:
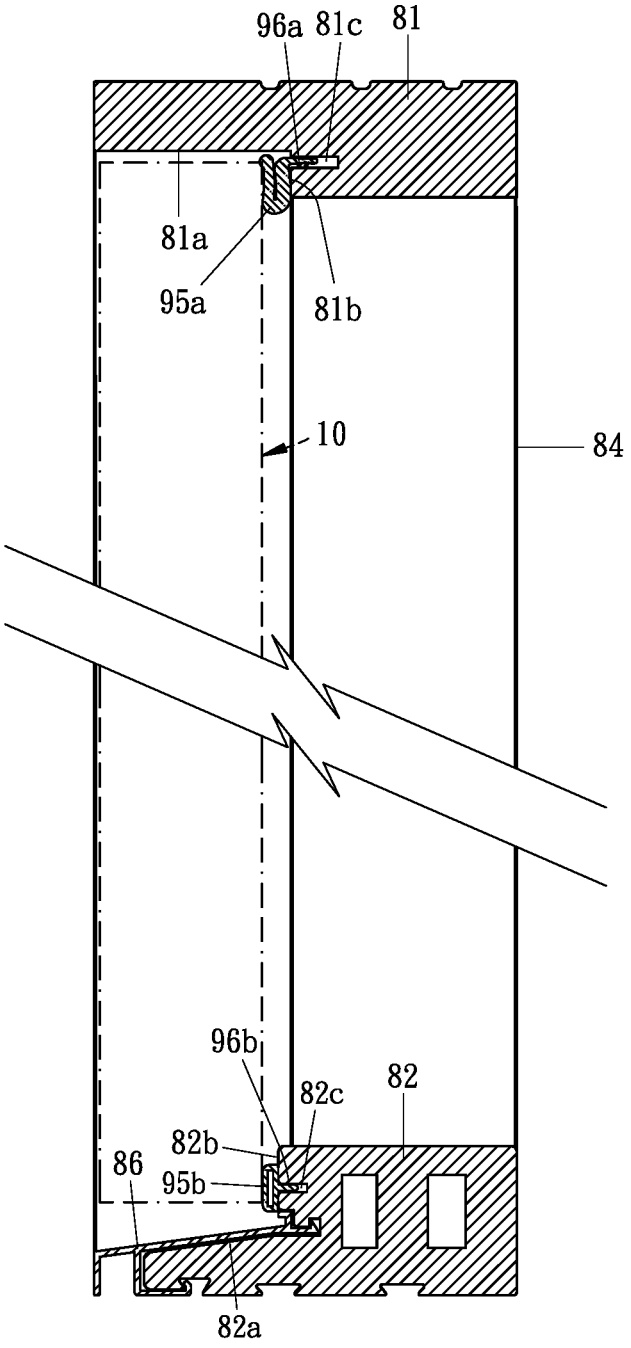
FIG. 11 is a partial enlargement of cross-sectional drawing along line a-a of the soundproof door assembly in FIG. 10.
Figure 12:
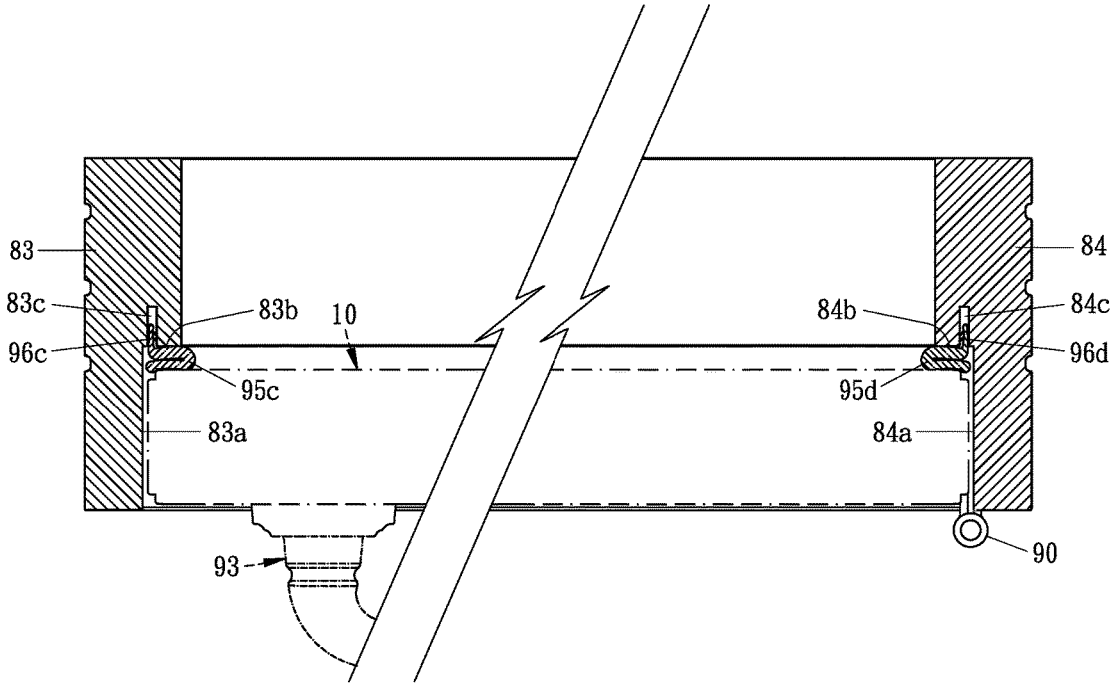
FIG. 12 is a partial enlargement of cross-sectional drawing along line b-b of the soundproof door assembly in FIG. 10.

Referred to from FIG. 10 to FIG. 12, the soundproof door 10 (or 15) of the present invention is a moving part, and the doorframe 80 of the present invention which is positioned proximate the soundproof door 10 (or 15) is a stationary frame. Each door hinge 90 has two long straps, one strap is fastened to the right stile member 24 (or, alternatively, fasten to the left stile member 23) of the soundproof door 10 (or 15) and the other is fastened to the adjacent hinge jamb 84 of the doorframe 80.

And, a doorknob 93 with a latch bolt 93*a* can be installed to the soundproof door 10 (or 15) through a generally conventional assembling technique so that the doorknob 93 may drive the soundproof door 10 (or 15) operated in either open or close stage.

The soundproof door assembly 100 of the present invention shows a longitudinally cross-sectional structure as shown in FIG. 11. And, the header 81 of the doorframe 80 is provided with a structural arrangement containing a depressed section 81*a* and a horizontal doorstop 81*b*, wherein the depressed section 81*a* is formed to accept the soundproof door 10 (or 15) if closed, and the horizontal doorstop 81*b* is formed to adjoin to the depressed section 81*a* to prevent the soundproof door 10 (or 15) from swinging through when closed.

As shown in FIG. 10 and FIG. 11, at the junction where the horizontal doorstop 81*b* is adjoining to the depressed section 81*a* of the header 81, an inserted slot 81*c* is formed along the junction.

Accordingly, a first soft packing strip 95*a* having a griping-mounting piece 96*a* is installed onto the header 81 by way of having its griping-mounting piece 96*a* wholly inserted into the inserted slot 81*c*, and the first soft packing strip 95 is then positioned into the right place on the outer side of the horizontal doorstop 81*b* of the header 81.

Further referred to FIG. 11, the doorsill 82 of the doorframe 80 has a depression section 82*a* in order to accept the soundproof door 10 (or 15) if closed and a protruding ridge 82*b* formed as a door stop next to the depressed section 82*a* in order to prevent the soundproof door 10 (or 15) from swinging through when closed.

On the surface of the protruding ridge 82*b*, an inserted slot 82*c* is formed thereon. Accordingly, a second soft packing strip 95*b* having a griping-mounting piece 96*b* is installed onto the doorsill 82 by way of having its griping-mounting piece 96*b* wholly inserted into the inserted slot 82*c*, and the second soft packing strip 95*b* is then positioned into the right place on the protruding ridge 82*b* of the doorsill 82.

As shown in FIG. 11, a rain shielding plate 86 made of aluminum alloy or thermoplastic material by extruding forming technique is optionally installed and covered onto the depressed section 82*a* of the doorsill 82 for preventing water from seeping into the doorsill 82 of the doorframe 80 under stress of weather.

Likewise, the soundproof door assembly 100 of the present invention shows a horizontally cross-sectional structure as shown in FIG. 12. The strike jamb 83 of the doorframe 80 therefore has a depressed section 83*a* and a longitudinal doorstop 83*b*, wherein the depressed section 83*a* is not only provided for a strike plate 94 affixed thereto to match with the latch bolt 93*a* of the doorknob 93 together as a conventional door lock, but also formed to accept the soundproof door 10 (or 15) if closed, and the longitudinal doorstop 83*b* is formed to adjoin to the depressed section 83*a* to prevent the soundproof door 10 (or 15) from swinging through when closed.

As shown in FIG. 10 and FIG. 12, at the junction where the longitudinal doorstop 83*b* is adjoining to the depressed section 83*a* of the strike jamb 83, an inserted slot 83*c* is formed along the junction.

Accordingly, a third soft packing strip 95*c* having a griping-mounting piece 96*c* is installed onto the strike jamb 83 by way of having its griping-mounting piece 96*c* wholly inserted into the inserted slot 83*c*, and the third soft packing strip 95*c* is then positioned into the right place on the outer side of the longitudinal doorstop 83*b* of the strike jamb 83.

Further referred to FIG. 12, the hinge jamb 84 of the doorframe 80 has a depressed section 84*a* and a longitudinal doorstop 84*b*, wherein the depressed section 84*a* is not only provided for one strap of the door hinges 90 affixed thereto, but also formed to accept the soundproof door 10 (or 15) if closed.

At the junction where the longitudinal doorstop 84*b* is adjoining to the depressed section 84*a*, an inserted slot 84*c* is formed along the junction.

Accordingly, a fourth soft packing strip 95*d* having a griping-mounting piece 96*d* is installed onto the hinge jamb 84 by way of having its griping-mounting piece 96*d* wholly inserted into the inserted slot 84*c*, and the fourth soft packing strip 95*d* is then positioned into the right place on the outer side of the longitudinal doorstop 84*b* of the hinge jamb 84.

The soundproof door assembly 100 of the present invention due to having an assembling arrangement as shown in from FIG. 10 to FIG. 12 may achieve a superior sound isolation quality, since there are no clearances existed in between the soundproof door 10 (or 15) and the doorframe 80.

The aforesaid soundproof door 10 or 15 of the present invention has function of sound isolation, and the doorframe 80 as well as those soft packing strip 95*a*, 95*b*, 95*c* and 95*d* are also excellent in functions of sound isolation. Accordingly, the soundproof door 10 (or 15) if closed to the doorframe 80 will at same time tightly press and touch to the first soft packing strip 95*a* installed on the header 81, the second soft packing strip 95*b* installed on the doorsill 82, the third soft packing strip 95*c* installed on the strike jamb 83 and the fourth soft packing strip 95*d* installed on the hinge jamb 84 of the doorframe 80. Therefore, the soundproof door assembly 100 of the present invention may effectively minimize the transmission of sound from one side of the soundproof door 10 of 15 to the other side.

The following examples are recited to demonstrate that the soundproof door 10 (or 15) or the soundproof door assembly 100 of the present invention if measured and evaluated for sound transmission class (STC) test has a STC number greater than STC 30 for door (or door assembly), preferably greater than STC 33 for door (or door assembly) or even greater than STC 38 for door (or door assembly), to minimize the transmission of sound at frequency of 500 Hz from one side of the soundproof door 10 (or 15) to the other side.

Sound Transmission Class (STC) Test:

The Sound Transmission Class (STC) is the most common sound reduction measurement in use, which is determined in accordance with both ASTM E413-10 (Classification for Rating Sound Insulation) and ASTM E90-90 (Standard Test Method for Laboratory Measurement of Airborne Sound Transmission Loss of Building Partitions and Elements).

Higher STC is generally better to reduction of sound vibration as it travels from one side of a door to the other.

EXAMPLE 1

A soundproof door having a total thickness T1 of 45 mm is assembled according to the structural composition shown as FIGS. 4-6.

The door skins 11 and 12 have a thickness of 2 mm and are made of SMC sheet, the quadrilateral frame 20 have a thickness of 41 mm and is made of laminated veneer lumber (LVL) board, and the multiple-layered core 30 comprises the spaced hard-soundproofing cores 40 each having a thickness of 8 mm and made of silicon magnesium board to block sound with high frequency over 500 Hz, the soft-soundproofing core 50 having a thickness of 25 mm and made of rock wool fiber board to block sound with high frequency beneath 500 Hz, and four reinforced members 60 each having a thickness of 25 mm and in parallel set up alongside each side of the soft-soundproofing core 50.

After STC test is determined in accordance with ASTM E413-10 and E90-09, the result is that the soundproof door of the Example 1 has an STC of 38 (or STC 38) for door.

EXAMPLE 2

A soundproof door assembled as the same specification as that of soundproof door of Example 1, in addition to the soft-soundproofing core 50 made of phenolic foaming board used to replace the rock wool fiber board used in Example 1.

After STC test is determined in accordance with ASTM E413-10 and E90-09, the result is that the soundproof door of the Example 2 has an STC 33 for door.

EXAMPLE 3

A soundproof door of Example 1 is mounted to a stationary doorframe positioned proximate the soundproof door via three door hinges and then assembled together as a soundproof door assembly having an assembling arrangement shown as FIGS. 10-12. The stationary doorframe is a quadrilateral door frame made of PVC composite extrusion board, and the quadrilateral door frame has been mounted a loop of soft packing strip used to tightly contact onto the door skin of the soundproof door if closed.

After STC test is determined in accordance with ASTM E413-10 and E90-09, the result is that the soundproof door assembly of the Example 3 has an STC 40 for door.

What is claimed is:

1. A soundproof door assembly for use in reduction of sound transmitted from one side of the door to the other side, having an STC number greater than of STC 30 determined in accordance with ASTM E413-10 and E90-09, comprising a soundproof door having a thickness of 30-70 mm, which comprising two door skins, one formed as a front door skin and the other formed as a rear door skin for the soundproof door respectively;

a quadrilateral frame, constituted by a top rail member, a bottom rail member, a left stile member and a right stile member to seal the perimeter of the door skins; and a multiple-layered core, to form a concrete inner portion of the door, which comprising;

two spaced hard-soundproofing cores, to block sound with high frequency over 500 Hz, each formed as a single-layered soundproofing core having a thickness of 3-12 mm and made of calcium silicate board, silicon magnesium board, glass fiber composite board or ceramic composite board; and a soft-soundproofing core, to block sound with high frequency beneath 500 Hz, interleaved in between the spaced hard-soundproofing cores to constitute with a sandwich structure, and the soft-soundproofing core is made of rock wool fiber board, glass fiber board, closed cell polyurethane foaming board, opened cell polyurethane foaming board, expandable polystyrene foaming board or expandable polyethylene foaming board;

a reinforced member positioned adjacent and extending parallel to a side of the soft-soundproofing core, and disposed and extending between the hard-soundproofing cores;

a doorframe, being a stationary quadrilateral door frame positioned proximately the soundproof door to support the soundproof door; and one or more door hinges used to control the soundproof door capably to swing relative to the doorframe; and a loop of soft packing strip, mounted on the quadrilateral door frame of the doorframe to tightly contact onto the door skin of the soundproof door if closed;

wherein the quadrilateral door frame of the doorframe is made from hard polyvinyl chloride (PVC) board, foamed PVC board, PVC composite extrusion board.

2. The soundproof door assembly as described in claim 1, wherein the multiple-layered core of the soundproof door has one of the two spaced hard-soundproofing cores formed as a multiple-layered soundproofing core which is constituted by two or more the single-layered soundproofing cores.

3. The soundproof door assembly as described in claim 1, a plurality of additional reinforced members each additional reinforced member being positioned adjacent and extending parallel to a respective side of the soft-soundproofing core, and disposed and extending between the hard-soundproofing cores.

4. The soundproof door assembly as described in claim 3, wherein the reinforced member is made of hard PVC board, PVC composite extrusion board, PS board, ABS board, high density particle board or LVL board.

5. The soundproof door assembly as described in claim 3, wherein one of the two spaced hard-soundproofing cores is formed as a multiple-layered soundproofing core constituted by two or more the single-layered soundproofing cores.

6. The soundproof door assembly as described in claim 1, having an STC number greater than of STC 33 determined in accordance with ASTM E413-10 and E90-09, wherein each of the two spaced hard-soundproofing cores is made of a silicon magnesium board, and the soft-soundproofing core is made of a phenolic foaming board.

7. The soundproof door assembly as described in claim 1, having an STC number greater than of STC 38 determined in accordance with ASTM E413-10 and E90-09, wherein each of the two spaced hard-soundproofing cores is made of a silicon magnesium board, and the soft-soundproofing core is made of a rock wool fiber board.

8. The soundproof door assembly as described in claim 1, having an STC number greater than of STC 40 determined in accordance with ASTM E413-10 and E90-09, wherein each of the two spaced hard-soundproofing cores is made of a silicon magnesium board, the soft-soundproofing core is made of a rock wool fiber board, and the quadrilateral door frame of the doorframe is made of PVC composite extrusion board.

9. A soundproof door assembly for use in reduction of sound transmitted from one side of the door to the other side, having an STC number greater than of STC 30 determined in accordance with ASTM E413-10 and E90-09, comprising a soundproof door having a thickness of 30-70 mm, which comprising two door skins, one formed as a front door skin and the other formed as a rear door skin for the soundproof door respectively;

a quadrilateral frame, constituted by a top rail member, a bottom rail member, a left stile member and a right stile member to seal the perimeter of the door skins; one or more reinforced members in parallel set up alongside one or more inner sides of the quadrilateral frame; and a multiple-layered core to form a concrete inner portion of the door, which comprising; two spaced hard-soundproofing cores, to block sound with high frequency over 500 Hz, each formed as a single-layered soundproofing core having a thickness of 3-12 mm and made of calcium silicate board, silicon magnesium board, glass fiber composite board or ceramic composite board; and a soft-soundproofing core, to block sound with high frequency beneath 500 Hz, interleaved in between the spaced hard-soundproofing cores to constitute with a sandwich structure, and the soft-soundproofing core is made of rock wool fiber board, glass fiber board, closed cell polyurethane foaming board, opened cell polyurethane foaming board, expandable polystyrene foaming board or expandable polyethylene foaming board;

a reinforced member positioned adjacent and extending parallel to a side of the soft-soundproofing core, and disposed and extending between the hard-soundproofing cores;

a doorframe, being a stationary quadrilateral door frame positioned proximately the soundproof door to support the soundproof door; and one or more door hinges used to control the soundproof door capably to swing relative to the doorframe; and a loop of soft packing strip, mounted on the quadrilateral door frame of the doorframe to tightly contact onto the door skin of the soundproof door if closed;

wherein the quadrilateral door frame of the doorframe is made from hard polyvinyl chloride (PVC) board, foamed PVC board, PVC composite extrusion board.

10. The soundproof door assembly as described in claim 9, wherein the multiple-layered core of the soundproof door has one of the two spaced hard-soundproofing cores formed as a multiple-layered soundproofing core which is constituted by two or more the single-layered soundproofing cores.

* * * * *